US005444928A

United States Patent [19]

Sagel

[11] Patent Number: 5,444,928

[45] Date of Patent: Aug. 29, 1995

[54] TELESCOPING BUILT-IN IRONING BOARD

[75] Inventor: Heinrich Sagel, Brakel, Germany

[73] Assignee: Vauth-Sagel GmbH & Co., Brakel, Germany

[21] Appl. No.: 304,221

[22] Filed: Sep. 12, 1994

[30] Foreign Application Priority Data

Sep. 11, 1993 [DE] Germany ..... 43 30 867.8

[51] Int. Cl.[6] ..... D06F 81/02

[52] U.S. Cl. ..... 38/139; 38/104

[58] Field of Search ..... 38/104, 112, 139; 108/33, 35, 40, 50, 53.3; 312/29

[56] References Cited

U.S. PATENT DOCUMENTS

| | | | |
|---|---|---|---|
| 2,298,002 | 10/1942 | Fay | 38/104 |
| 2,523,425 | 9/1950 | Gargaglione | 38/112 X |
| 2,639,523 | 5/1953 | Beiger | 38/139 |
| 3,129,676 | 4/1964 | Brooks et al. | 108/33 |
| 3,732,639 | 5/1973 | Elder | 38/139 |
| 4,799,321 | 1/1989 | Johnson | 38/104 X |

FOREIGN PATENT DOCUMENTS

| | | | |
|---|---|---|---|
| 0641354 | 9/1993 | Australia | 38/139 |
| 2354732 | 1/1978 | France . | |
| 9111464 | 1/1992 | Germany . | |
| 232862 | 6/1944 | Switzerland . | |
| 516744 | 1/1940 | United Kingdom . | |
| 1387433 | 3/1975 | United Kingdom . | |
| 9105497 | 5/1991 | WIPO . | |

*Primary Examiner*—Clifford D. Crowder
*Assistant Examiner*—Ismael Izaguirre
*Attorney, Agent, or Firm*—Browdy and Neimark

[57] ABSTRACT

The ironing board has a rear board part (3) and a front board part (4) pivotably connected by a hinge (5), where the front board part (4) can be folded on top of the rear board part (3) into the resting position or can be folded away from the rear board part (3) into the working position opened out and on the same plane as the rear board part (3). The rear board part (3) is supported in such a way that it is pivotable from the lower resting position into the higher working position by parallel guide rods (8) seated in displacement guide (6) of a slider (7). A guide support (11) is disposed between and connect to the front board part (4) and the displacement guide (6) in a hinged manner and is pivotable with the front board part (4). When the front board part (4) is manually displaced, it forms a forced guidance for the rear board part (3) and its parallel guide rods (8), which, in conjunction with the guide support, support the front board part (4) in the operating or working position of the ironing board.

11 Claims, 2 Drawing Sheets

TELESCOPING BUILT-IN IRONING BOARD

FIELD OF THE INVENTION

The invention relates to a telescoping built-in ironing board with a rear board part and a front board part pivotably connected therewith by a hinge. It can be folded on top of the rear part into the resting position and can also be opened out and folded away from the rear part into a working position located in the same plane as the rear board part, wherein the rear part is supported such that it is pivotable from the lower resting position into the upper working position by parallel guide rods which are seated in a displacement guide of a slider.

BACKGROUND OF THE INVENTION

A telescoping ironing board is known from German Utility Model 91 11 464. In this case the front ironing board part, which can be folded away from the rear ironing board part into the working position, is supported by an additional support brace and is fixed by a groove and tongue connection, and the support brace is connected with a parallelogram guide rod via a pivot lever.

In addition, a tension member is associated with the rear ironing board part, which is force-guided in an additional displacement guide and causes a constrained movement of the parallelogram guide rods and the two ironing board parts which are folded on top of each other into the pulled-out position, by means of which the upward pivoting of the two ironing board parts with the support brace takes place. Only then, in the pulled-out position, can the upper ironing board part, which constitutes the front, be folded open toward the front and is subsequently locked with the support brace in the groove and tongue connection.

Due to the additional guidance, pivot and connecting means, this ironing board is comparatively elaborate and requires that extensive measurements be taken when being installed since all components must be in a defined relation to the pull-out all components must be in a defined relation to the pull-out guide and the working surface of the cabinet. This is of particular importance, because the fixing in place of the ironing board in the working position is provided only by the rear board part resting on the working surface, so that an unstable working position is created when tolerances in measurements are taken into account.

It is the object of the invention to provide an improvement to a telescoping built-in ironing board, having a small number of simple structural parts. The telescoping built-in ironing board of the invention allows for constrained movement of the ironing board parts into a secure working or operating position where it can be locked into place in a stable manner and where it allows for simple assembly with few structural measurement required.

This object is attained in accordance with the invention by the characterizing features of claim 1; the dependent claims following it contain design characteristics which represent advantageous and useful further embodiments of the attainment of the object.

The telescoping built-in ironing board of the invention operates with two board parts which are pivotable in respect to each other and with parallel guide rods disposed between the pull-out guide. In an advantageous manner it is provided with a guide support between the displacement guide and the front ironing board part, which is hingeably connected with the two parts and performs a pivot movement in the pull-out direction as well as in the reverse direction over a limited pivot angle area.

After pulling the ironing board out of the resting position into the use position by means of the drawer, a forced guide of the parallelogram guide rods and the rear ironing board part is automatically achieved by pivoting the front ironing board part via the guide support. This rear ironing board part moves upward into the use position while maintaining its horizontal position, and at the same time the guide support pivots back in a direction opposite the previous pull-out direction into a support direction and supports the front ironing board part in the horizontal operating position, too.

In the course of this the parallelogram guide rods are fixed in respect to the displacement guide by a stop, and the guide support is arrested in the support position by a fixing device. Because of this the entire lever mechanism, i.e. the parallelogram guide rods and the guide support, rest on a lever hinge which covers a total of six pivot axes and in this way maintain the ironing board parts in the secured working position. In addition, the rear ironing board part rests against the front edge of the working surface of the cabinet.

When pivoting the front ironing board part into the working/operating position, the guide support is automatically pivoted around its pivot axis at the displacement guide or at a drawer panel and in this way causes the displacement in height of the parallelogram guide rods along with the rear ironing board pat as well as the pivot movement opposite the pull-out direction of the two ironing board parts into the working/operating position. In this position the guide support then takes up a less inclined position than the parallelogram guide rod, so that positional fixation is achieved and automatically taken up on the basis of the special six pivot bearing point arrangements in connection with the stops and fixing devices.

Handling of this built-in ironing board to bring it into its operating and resting positions of use and rest has been achieved in an extremely simple manner with merely the additional guide support. Based on this simple structural part, installation is also possible with fewer mounting steps.

A variation of an exemplary embodiment is illustrated in the drawings and will be described in detail below.

DETAILED DESCRIPTION OF THE INVENTION

Figure 1:
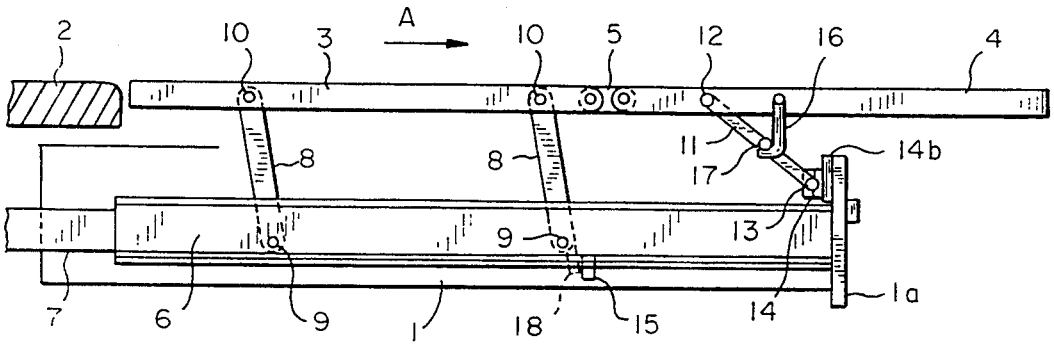
FIG. 1 is a lateral view of a built-in ironing board in the pulled-out operating position.

In FIG. 1, the built-in ironing board built into a cabinet drawer (1) which can be pulled out and is below the working surface (2) of a cabinet top or counter.

This ironing board is composed of a rear board part (3) an a front board part pivotably connected by a hinge (5), where the front board part (4) can be either folded on top of the rear board part (3) into the resting position or can be opened out and folded away from the rear board part (3) into the working position on the same plane as the rear board part. The rear part (3) is supported in such a way that it is pivotable from the lower resting position into the higher working position by parallel guide rods (8) seated in displacement guide (6) of a slider (7).

Two parallel guide rods (8) are disposed on each side of the rear board part (3) and spaced apart in the pull-out direction (A) of the ironing board with a lower end engaging the displacement guide (6) in a pivot axis (9) and with their upper end engaging the rear board point (3) in a pivot axis (10). These parallel guide rods are manually displaced on their pivot axes in the form of a changing parallelogram to displace the rear board part (3) upward while maintaining the rear board part in a level horizontal position.

A guide support (11)—guidance and support element—is disposed between the front board part (4) and the back side of the cabinet drawer panel (1*a*) in a hinged manner and is pivotable with the front board part (4). When the front board part (4) is manually displaced, it forms a forced guidance for the rear board part (3) and its parallel guide rods (8) and in conjunction with guide support (11) support the front board part (4) in the operating position of the ironing board.

The guide support (11) is embodied in the form of a guide and support lever and is held with one longitudinal end at a distance from the rear-front hinge (5) in a pivot axis (12) on the front board part (4), and with the other longitudinal end in a pivot axis (13) on a bearing (14) disposed at the back side of cabinet drawer panel (1*a*).

The guide support (11) is pivoted from the resting position in accordance with FIG. 6 into the position in accordance with FIG. 3 through an obtuse angle area around its pivot axis (13) at the bearing (14) and subsequently into the operating position in accordance with FIG. 1. In the resting position it encloses an acute angle. The sequence takes place in reverse manner when folding the ironing board back into its resting position.

In the pulled-out and folded-apart operating position of the ironing board, the parallel guide rods (8) and the guide support (11) extend obliquely upward opposite the pull-out direction (A)—toward the back—and in the process the guide support (11) takes up an oblique position which is oriented more toward the back (more acute angle) than the parallel guide rods (8) (FIG. 1).

In the operating position of the ironing board, the parallel guide rods (8) are limited in the pivoted position by a stop (15) on the displacement guide (6). The guide support (11) is arrested in its operating position by a fixing device (16) (FIG. 1).

At least one parallel guide rod (8) has a link (18) downwardly extending beyond its pivot axis (9) to engage with the displacement guide (6) where, in the operating position of the built-in ironing board, the link cooperates with a stop (15) disposed on the displacement guide (6) in front of the guide rod pivot axis (9) in the pull-out direction (A). (FIG. 1).

The fixing device (16) is formed by a hook, pivotably seated on the front board part (4) at a distance from the guide support pivot axis (12), and by a peg (17) projecting away from the guide support (11), under which the hook (16) extends in the operating support position of the guide support (FIG. 1).

Figure 2:
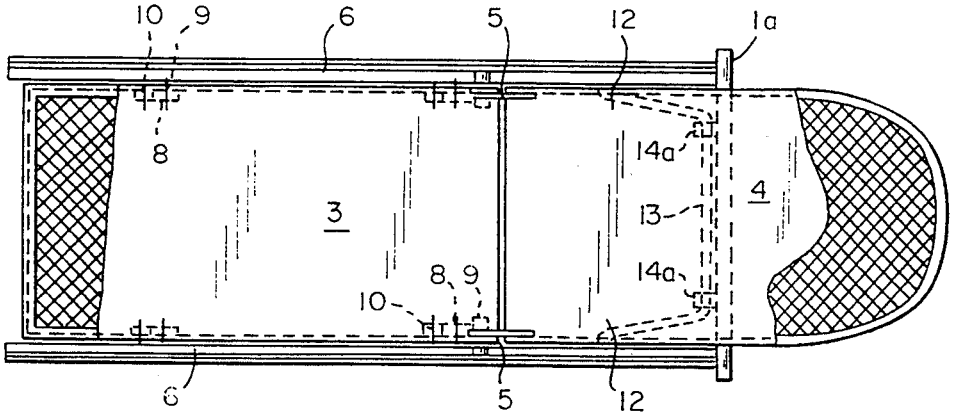
FIG. 2 is a top view of the built-in ironing board of FIG. 1 with a guide support in the form of a U-shaped hoop.

In a preferred manner the guide support ( 11 ) is embodied as a U-shaped hoop (a rod with a round cross section, bent into the shape of a U), which forms the pivot axis (13) on the back side of a cabinet drawer panel held in a bearing (14) with the straight part of its U and engages the two longitudinal sides of the front board part (4) with the free ends of the two legs of its U to form pivot axes (12), as clearly shown in Fig. 2.

Figure 5:
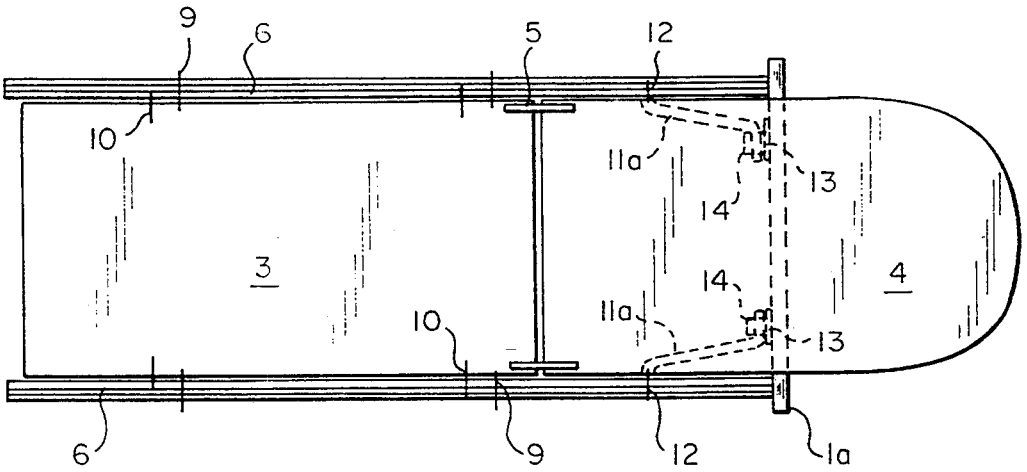
FIG. 5 is a top view of the built-in ironing board in the opened operating position with a different embodiment of the guide supports.

The guide support (11) can also be formed from two lateral Z-shaped guide and support levers (11*a*)—bent rods of round cross section—which engage the bearing (14) on the back side of cabinet drawer panel (la) guide (6) with one leg of the Z as the pivot axis (13). With the other leg of the Z as the pivot axis (12) they engage respectively one long side of the front board part (4), as shown in FIG. 5.

The bearing (14) at the displacement guide (6) is formed by at least one bearing bush (14*a*) and a fastening plate (14*b*). The fastening plate (14*b*) can be fixed on a cross connector (19) disposed the pair of displacement guides (6) in accordance with FIGS. 3 and 6, or on a cabinet drawer panel (1*a*) in accordance with FIGS. 1, 4 and 5.

Figure 3:
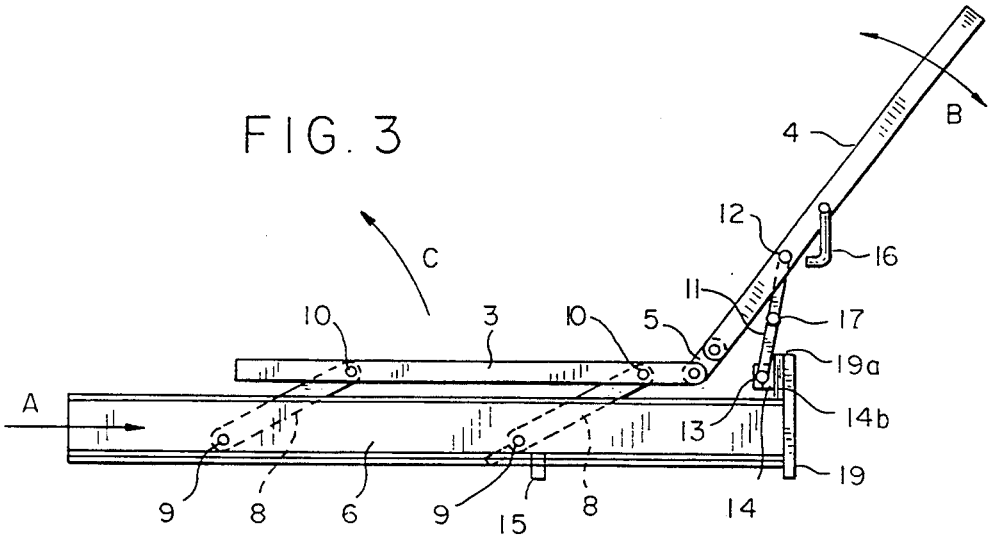
FIG. 3 is a lateral view of the built-in ironing board in a pulled-out and partially pivoted position.
Figure 4:
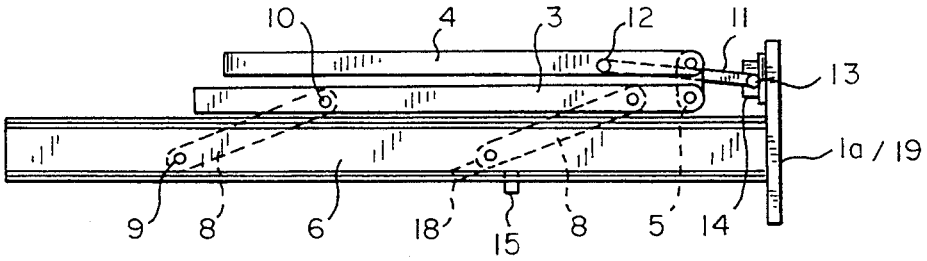
FIG. 4 is a lateral view of the built-in ironing board in a folded and partly lowered intermediate position with the front board part fold on top of the rear board part.

The upper edge of fastening plate (14*b*) of bearing (14), or of cross connector (19) of displacement guides (6) forms a pivot limiting stop (19*a*) for the guide support (11) in the pull-out direction (A)—FIG. 3—.

The hinge (5) or joint is formed, for example, by two lateral tongues and two hinge shafts attached to the rear and front board parts (3, 4).

The rear and front board parts (3, 4) are made as support parts from a so-called stretch plate or perforated plate and an ironing layer or ironing cover.

Figure 6:
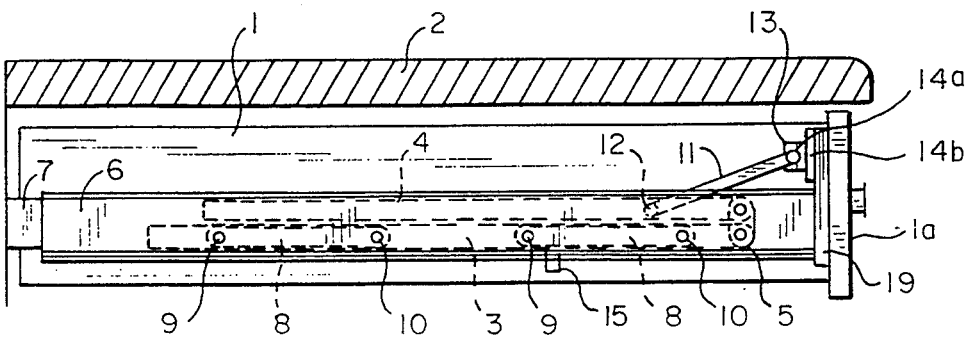
FIG. 6 is a lateral view of the built-in ironing board in the retracted resting position.

In the resting position of the built-in ironing board, the front board part (4) rests on top of the ear board part (3) at the bottom of the drawer (1), as shown in FIG. 6. The drawer (1) still has sufficient space for housing various ironing aids above the ironing board.

To use the ironing board, the drawer (1) is pulled out in the direction of the arrow (A) and the front board part (4) is grasped by the end opposite the hinge (5) located in the back of the drawer (1) and is then pivoted upward about the hinge (5) in the direction of the arrow (B) in FIG. 3. In the process the guide support (11) is also pivoted until it abuts against the pivot limiting stop (19*a*) and forms an abutment, shown in FIG. 3. The front board part (4) is further pivoted in the direction of the arrow (B), which causes the guide support (11) to pivot the rear board part. (3) with its two parallel guide rods (8) upward about hinge 5 and pivot axes (9, 10) in the direction of the arrow (C) .

While the guide support (11) is pivoted in the direction of the arrow (C), and the front part (4) , which continues to be pivoted in the direction of the arrow (B) until the horizontal position is reached, the hinged rear part (3) is pushed a short distance back opposite from the pull-out direction (A) until the pivot movement of the parallel guide rod (8) is limited by the contact between link (18) and the stop (15).

In this position the guide support (11) is also pivoted back into its oblique support position as shown in FIG. 1 and the hook (16) swings down behind the peg (17) because of its weight and its pivoted seating to arrest the movement of the guide support (11). In FIG. 1, with its rear edge facing away from the hinge (5), the rear board part (3) rests against the front edge of the working surface (2) and the entire ironing board is fixed in its stable operating position by means of the arrested parallel guide rods (8) and guide support (11).

The ironing board is folded back and retracted into its resting position using the reverse sequence, where the hook (16) is first manually loosened with a finger. The disposition of the link (18) and the stop (15) allows the pivoting away of the parallel guide rods (8) .

Alternatively, the hook (16) as a fixing device can be substituted with a stop element, bolt or the like.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

I claim:

1. A built-in ironing board, comprising:

a rear board part having a top face;

a front board part having two longitudinal sides and a top face;

a hinge pivotably connecting said front board part and said rear board part;

a displacement guide having a front end a rear end;

a plurality of parallel guide rods having an upper end and a lower end and being disposed between said rear board part and said displacement guide, said lower end of said parallel guide rods being seated on said displacement guide;

said front board part capable of being folded at said hinge over on top of said rear board part into a resting position so that said top face of said front board part rests on said top face of said rear board part, said front board part capable of being folded out at said hinge and away from said rear board part into an operating position, said top face of said front board part forms a plane with said top face of said rear board part, said rear board part being supported so that it is pivotable from said resting position into said operating position by said plurality of parallel guide rods seated in said displacement guide;

a cross-connector means; and a guide support disposed between said front board part and said displacement guide in a hinged pivotable manner, said guide support capable of forming a forced guidance for said rear board part (3) and said parallel guide rods (8), and of supporting said front board part (4) in said operating position.

2. A built-in ironing board in accordance with claim 1, wherein said guide support (11) is a guide and support lever having two longitudinal ends, one of said longitudinal ends secured at a distance from said hinge (5) in a first pivot axis (12) on said front board part (4), another of said longitudinal ends in a secured second pivot axis (13) on a bearing (14) secured to said cross-connector means.

3. A built-in ironing board in accordance with claim 2, wherein said guide support (11) is pivoted through an obtuse angle about said second pivot axis (13) at said bearing (14).

4. A built-in ironing board in accordance with claim 1, wherein, in said operating position of the ironing board, said parallel guide rods (8) and said guide support (11) extend obliquely upward and back toward said rear end of said displacement guide, said guide support (11) takes up an oblique position which is slanted more towards said rear end of said displacement guide than said parallel guide rods (8).

5. A built-in ironing board in accordance with of claim 1, further comprising a stop and a fixing device, wherein said parallel guide rods (8) being limited in pivoting position by said stop (15) on said displacement guide (6), and said guide support (11) being arrested in said operating position (16) by said fixing device (16).

6. A built-in ironing board in accordance with claim 5, wherein at least one of said parallel guide rods (8) comprises a link (18) downwardly extending beyond a pivot axis (9) disposed at said lower end of said parallel guide rods and engaging said displacement guide (6) which, in said operating position of the ironing board cooperates with said stop (15) disposed on said displacement guide (6) between said guide rod pivot axis (9) and said front end of said displacement guide.

7. A built-in ironing board in accordance with claim 5, wherein said fixing device (16) comprises a peg (17) disposed on and projecting away from said guide support (11); and a hook (16) pivotably seated on said front board part (4) at a distance from said guide support pivot axis (12) for cooperating with said peg to secure said built-in ironing board in said operating position.

8. A built-in ironing board in accordance with claim 1, wherein said guide support (11) is a U-shaped hoop having a straight point and two legs, each of said two legs having a free end, said U-shaped hoop forming a pivot axis (13) on said displacement guide side held in a bearing (14) with said straight part of said U-shaped hoop and engaging said two longitudinal sides of said front board part (4) with said free end of each of said two legs of said U-shaped hoop to form pivot axes (12).

9. A built-in ironing board in accordance with claim 1, wherein a bearing (14) is disposed on the back of the drawer panel of the cabinet housing said built-in ironing board, and said guide support (11) is formed from two lateral Z-shaped guide and support levers (11*a*) each having two legs, said Z-shaped guide and support levers engaging said bearing (14) with one of said two legs of said Z-shaped guide and support levers as the pivot axis (13), and the other of said two legs of said Z-shaped guide and support levers as the pivot axis (12) engaging one of said two longitudinal side of said front board part (4).

10. A built-in ironing board in accordance with claim 1, further comprising a bearing (14) disposed on said cross-connector means, wherein said bearing (14) is formed by at least one bearing bush (14*a*) and a fastening plate (14*b*), wherein the fastening plate (14*b*) is fixed on said cross-connector means—transverse support—as a cross-connector (19) and/or on the back of the drawer panel of the cabinet housing said built-in ironing board (1*a*).

11. A built-in ironing board in accordance with claim 10, wherein an upper edge of said fastening plate (14*b*) of said bearing (14), or the cross-connector (19) forms a pivot limiting stop (19*a*) for said guide support (11) in a pull-out direction (A).

* * * * *